United States Patent [19]

Tae

[11] 3,980,252

[45] Sept. 14, 1976

[54] WIRE ROPE SPOOLING MECHANISM

[75] Inventor: Margus Tae, Islington, Canada

[73] Assignee: John T. Hepburn Limited, Toronto, Canada

[22] Filed: Oct. 31, 1975

[21] Appl. No.: 627,823

[52] U.S. Cl. ..... 242/158.3; 74/57; 242/43 R; 242/158.5

[51] Int. Cl.[2] ..... B65H 54/28

[58] Field of Search ..... 242/43, 43.1, 158 R, 242/158.2, 158.3, 158.5; 74/57, 567

[56] References Cited

UNITED STATES PATENTS

| | | | |
|---|---|---|---|
| 3,270,982 | 9/1966 | Prange | 242/158.3 |
| 3,309,066 | 3/1967 | Carlson | 242/158.3 UX |
| 3,332,634 | 7/1967 | Somervell et al. | 242/158.3 X |
| 3,447,760 | 6/1969 | Sarah | 242/158.3 X |
| 3,672,587 | 6/1972 | Pierce | 242/43 |
| 3,799,464 | 3/1974 | Bosch | 242/43 |
| 3,836,087 | 9/1974 | Tschentscher | 242/43 |

*Primary Examiner*—John Petrakes

[57] ABSTRACT

An improved spooling device is provided having a drive shaft defining a track including conventional douple helices which are connected at their ends by parts of the track having any suitable curved or straight contour. An assembly on the drive shaft is made to reciprocate by engagement with the track for guiding a rope to and from a drum. The assembly includes two pivotal followers and a fixed center follower. When the assembly is moving axially in one direction, the pivotal followers are engaged in one helix and are in respective first positions. Then, when the assembly is returning in the opposite axial direction the followers are guided by the other helix and the pivotal followers are in respective second positions. Consequently the fixed follower and one of the pivotal followers take the load when the assembly is being moved in one direction whereas the fixed follower and the other of the pivotal followers take the load when moving the assembly in the opposite direction.

3 Claims, 7 Drawing Figures

WIRE ROPE SPOOLING MECHANISM

This invention relates to a spooling mechanism of a type which is particularly suitable for use in a winch to lay wire rope on a drum.

The spooling mechanism will be described with reference to a winch because it has particular use in such a structure. However it is envisaged that the spooling mechanism would be of use wherever it is required to convert the rotational movement of a shaft to reciprocating movement of an assembly on the shaft.

When wire rope or cable is being drawn onto a winch drum, it is necessary to guide the rope so that it covers the drum uniformly to limit damage to the rope and to obtain maximum use of a given drum length. Consequently it has become common to incorporate a spooling device of some kind into winches and such structures for guiding the rope onto the drum in uniform orderly layers.

A common type of spooling device consists of a shaft which is driven at a speed related to the speed of a drum for reciprocating an assembly on the shaft. Wire rope or the like passes through the assembly and is laid on the drum in uniform layers. It is necessary that the spooling device be capable of absorbing side loads because the rope may be led to the winch at angles other than 90 degrees to the axis of the winch drum. Because of these loads, damage to the mechanism is common. A typical problem lies in the connection between the drive shaft and the assembly on the shaft. Commonly, the shaft includes a double helical groove joined at its ends by carefully machined contours to guide a peg which is part of the assembly. When the peg crosses junctions between the helical grooves there is a sudden load transfer which can build up locally and cause damage. Similarly, when the peg leaves the end of the helix and enters the carefully machined groove, there is a tendency for heavy wear due to the difficulty of blending two opposite helices into one another while accommodating a peg which is designed to cross junctions between the helices. The problem is particularly acute where heavy loads are used such as on a ship's winch or the like.

It has been found that an improved spooling device can be provided having a drive shaft defining a track having conventional double helices which are connected at their ends by parts of the track having any suitable curved or straight contour. An assembly on the drive shaft is made to reciprocate by engagement with the track for guiding a rope to and from a drum. The assembly includes two pivotal followers and a fixed centre follower. When the assembly is moving axially in one direction, the pivotal followers are engaged in one helix and are in respective first positions. Then, when the assembly is returning in the opposite axial direction the followers are guided by the other helix and the pivotal followers are in respective second positions. Consequently the fixed follower and one of the pivotal followers take the load when the assembly is being moved in one direction whereas the fixed follower and the other of the pivotal followers take the load when moving the assembly in the opposite direction.

The invention will be better understood with reference to the drawings, in which.

Figure 1:
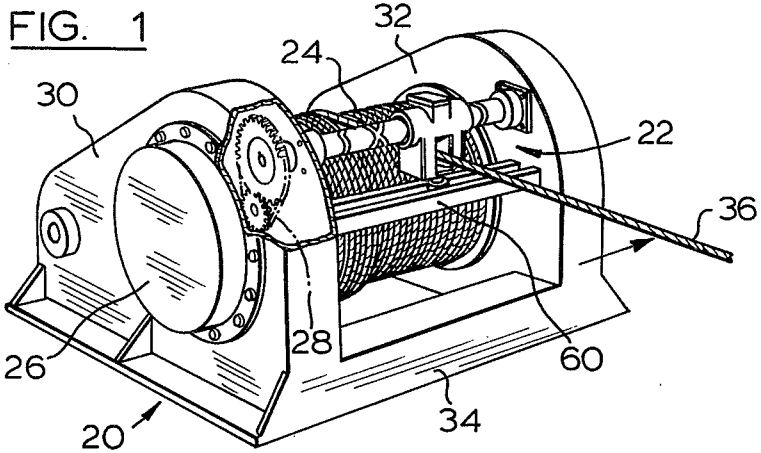
FIG. 1 is a perspective view of a winch incorporating a preferred embodiment of a wire rope spooling mechanism according to the invention.

Reference is first made to FIG. 1 which illustrates a winch 20 incorporating a spooling mechanism 22 according to the invention. The winch 20 also includes a winding drum 24 connected to a drive 26 which also drives the wire rope spooling mechanism 22 by way of a drive chain 28. The drum 24 and mechanism 22 are mounted between a pair of end structures 30, 32 forming part of a conventional winch frame 34.

In operation, the drive 26 causes the drum 24 to rotate and the mechanism 22 to guide wire rope 36 which is either moving on to or off the drum 24.

Figure 2:
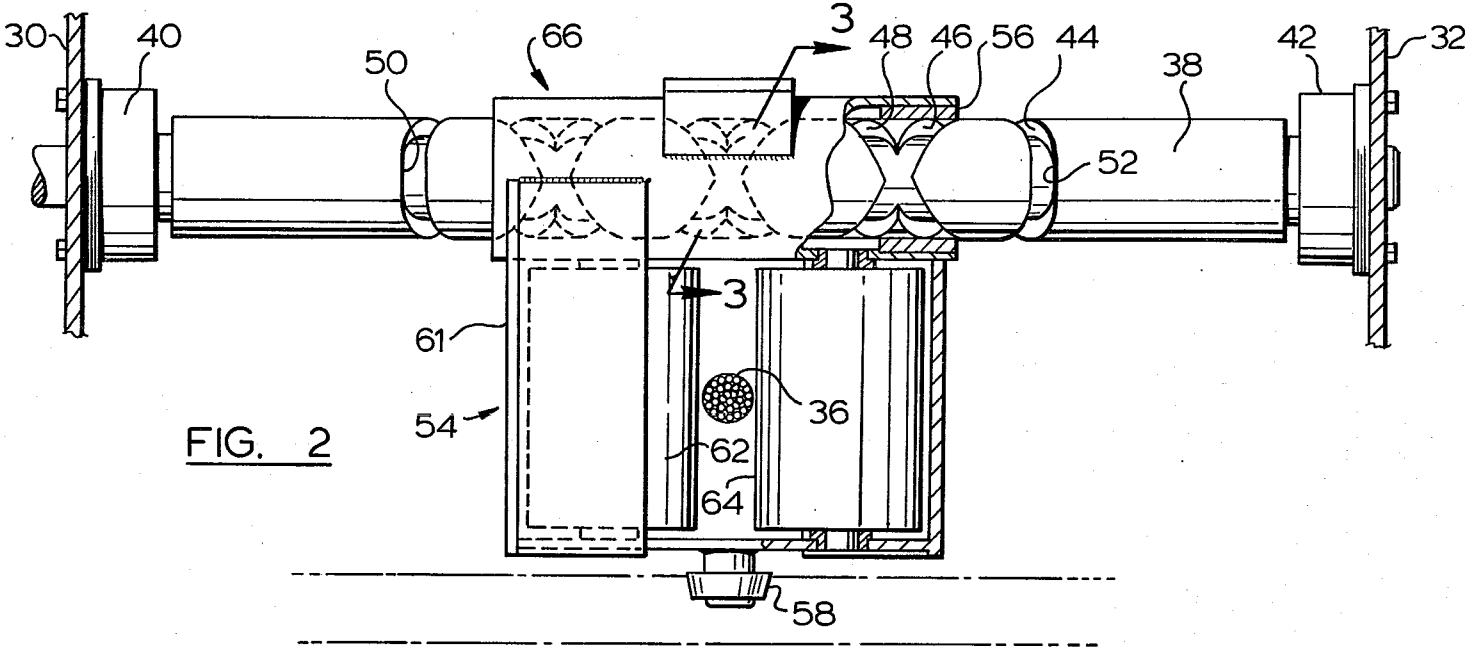
FIG. 2 is a front view of the spooling mechanism.

The spooling mechanism 22 is better seen in FIG. 2 in which it will be seen that the mechanism includes a drive shaft 38 mounted in bearing assemblies 40, 42 attached to respective end structures 30, 32. The bearing assemblies are of a type which both allow rotation and locate the shaft longitudinally for absorbing thrust created when the rope 36 exerts a force component along the axis of the shaft 38.

The drive shaft 38 has a major central portion which is generally cylindrical and which defines a continuous track 44. This track is effectively in four parts. The first part 46 is helical in one direction about the shaft 38, a second part 48 is helical in the other direction about the shaft; and respective third and fourth parts 50, 52 connect respective ends of the helical parts to complete the continuous track 44. Both helical parts 46, 48 have the same pitch and meet at a plurality of cross-over junctions.

The mechanism 22 also includes a rope guide assembly 54 which includes a pair of journal bearings 56 (one of which is seen) for locating the assembly 54 on the drive shaft 38. As will be described, the assembly 54 includes three followers engaged in the track 44 to cause the assembly 54 to reciprocate as the shaft 38 rotates. The assembly 54 is retained in an upright position as it reciprocates by a roller guide 58 which engages in a fixed channel 60 (FIG. 1) attached to the frame 34 and lying parallel to the axes of the drum and the drive shaft.

The assembly 54 also includes a prefabricated housing 61 containing a pair of parallel guide rollers 62, 64 arranged to rotate for guiding the wire rope 36. Above the rollers 62, 64 is a follower assembly 66 which is better seen in FIG. 3. This assembly includes a tubular element 68 which contains the journal bearings 56 (FIG. 2) at its ends and which is cut away adjacent its center to provide access for respective pivotal followers 70, 72 and fixed follower 74. These followers are mounted in a support block 76 which is attached by bolts (not shown) to a machined plate 77 which is in turn welded to the element 68.

Figure 3:
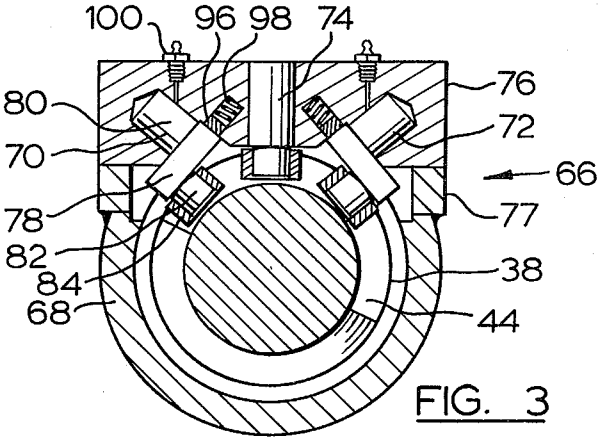
FIG. 3 is a sectional end view on line 3—3 of FIG. 2.
Figure 4:
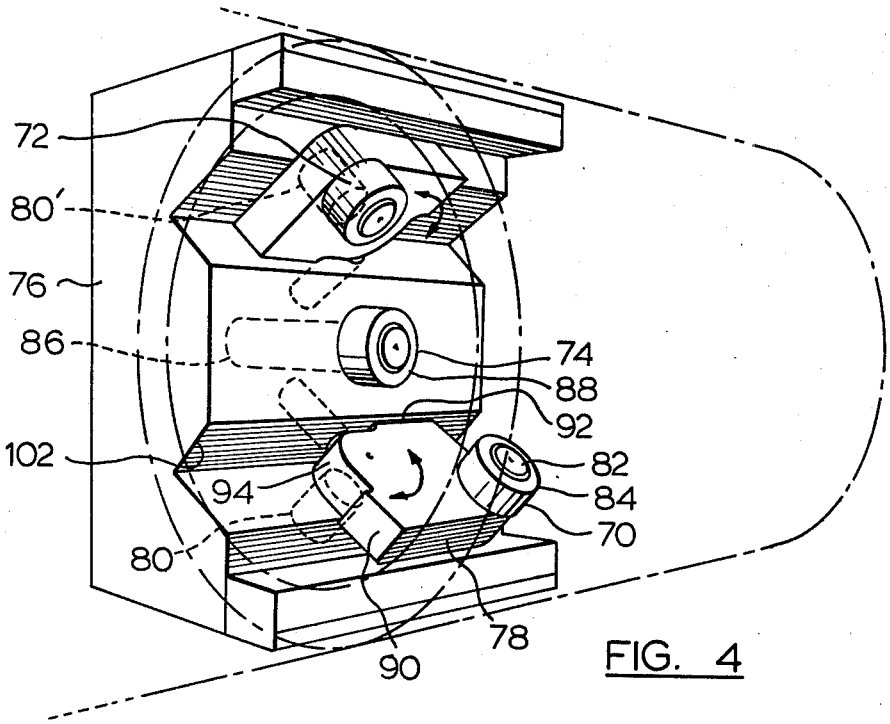
FIG. 4 is a perspective view of a support block and followers forming part of the spooling mechanism.

FIG. 3 represents an oblique section on line 3—3 of FIG. 2 and the true arrangement of the followers is shown in FIG. 4. Details of the followers will now be described.

As seen in FIG. 4, pivotal followers 70, 72 are arranged about the fixed follower 74 to lie in a helical part of the track 44. The arrows indicate that the pivotal followers can be moved and such movement effectively converts the positions of these followers for engagement in a second helical part of the track 44. Consequently, it is possible for the followers to be arranged to lie either in the part 46 of track 44 or in the part 48. This will be more fully described with reference to the use of the mechanism 22.

Pivotal follower 70 is typical of both followers 70, 72 and will now be described in detail with reference to FIGS. 3 and 4. The follower 70 includes a substantial body member 78 to which is attached a pivot pin 80 engaged obliquely in the support block 76. Offset from the axis of the pin 80 is a roller support pin 82 on which is engaged a hardened roller 84. The axis of the pivot pin 80 lies in a common plane both with the axis of the corresponding pin of the follower 72 and with the axis of a roller support pin 86 which supports a roller 88 of the fixed follower 74. The plane lies perpendicularly to the axis of drive shaft 38 when the rope guide assembly is in position on the shaft 38. Also the axes of the first pins of followers 70, 72 meet on a line passing perpendicularly through the axis of the drive shaft and coincide with the axis of pin 86 of fixed follower 74.

Returning to follower 70, the body member 78 has three functional side surfaces. All of the surfaces are parallel to the axis of the pivot pin 80 and include a flat first surface 90 and a flat second surface 92 lying in a plane perpendicular to a plane containing the surface 90. The third surface 94 extends between the surfaces 90, 92 and includes a cylindrical quadrant about the axis of the pivot pin 80. As better seen in FIG. 3, this last-mentioned surface co-operates with a friction pad 96 engaged in a suitable opening in the support block 76. The pad 96 is biased outwardly by a compression spring 98 to retain the pivotal follower in position so that it will not be dislodged by vibration. This could be important if the follower were left at an intersection between parts 46, 48 of the track 44 for an extended period. Without the pad 96 and spring 98 the follower could move under vibration forces so that upon starting up the mechanism the follower could tend to move in the wrong part of track 44 and the mechanism would then fail.

Pivot pin 80 is shown connected to a grease nipple 100 but can be force lubricated if preferred.

The pivotal follower 70 is located in the block 76 for engagement with an inclined face 102 of the block. In the position shown in FIG. 4, surface 92 is in engagement with the face 102 to prevent further rotation in a direction towards the face 102. As seen in FIG. 4 the followers are in position to follow part 48 of track 44 (FIG. 2) and when the followers are to follow part 46 then the pivotal followers 70, 72 must move about their respective pivot pins 80, 80'. Consequently face 90 of follower 70 then moves into engagement with face 102 to locate this follower for movement in part 46 of track 44 (FIG. 2). This movement and the engagement against face 102 will be more fully described with reference to FIGS. 5 to 7.

Figure 5:
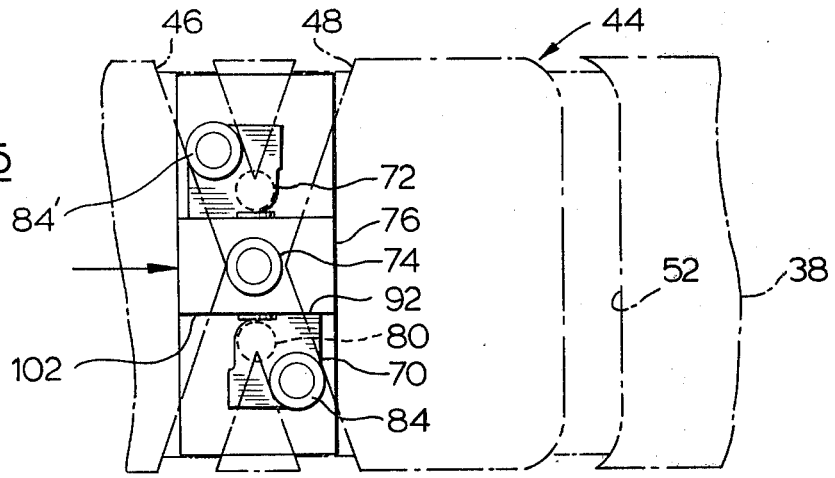
FIGS. 5 to 7 are diagrammatic views of the spooling mechanism in operation.
Figure 6:
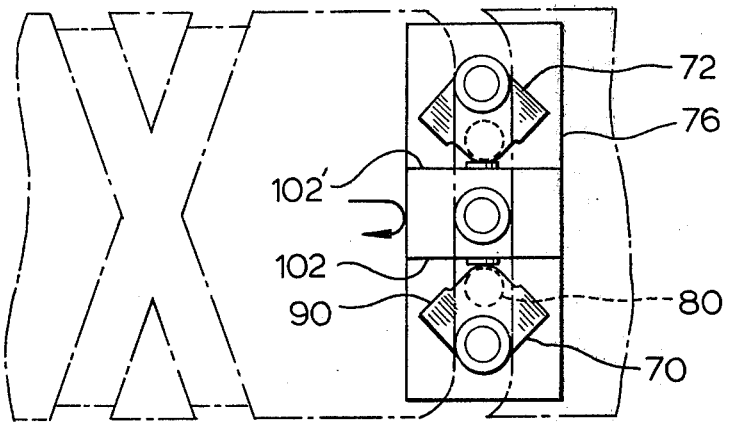

As seen in the diagrammatic FIG. 5, shaft 38 has rotated into a position in which the fixed follower 74 is at a central point of one of the intersections between parts 46, 48 of track 44. Roller 84' of pivotal follower 72 and roller 84 of the follower 70 are engaged in part 46. It it is assumed that the shaft 38 is rotating such that the support block 76 of the guide assembly 54 (FIG. 2) is moving to the right of FIG. 5, then the roller 84 has already passed the intersection between parts 46, 48 of track 44. Also, it is significant that this leading follower is capable of transmitting drive forces from shaft 38 to the block 76. This is because the force from the shaft

38 tends to rotate the follower 70 about pivot pin 80 in an anti-clockwise direction as drawn in FIG. 5. Consequently surface 92 is in the firm engagement with face 102 of the block 76. As a result no rotation of this follower can take place and the follower is effectively fixed while it transmits forces to the block 76. By contrast, follower 72 is in such a position that if an attempt were made to transmit force to this follower to move the block 76 to the right of FIG. 5, then the follower 72 would simply rotate so that this follower cannot in fact transmit force to move the block 76 in this direction. Consequently in the position drawn, substantially all of the force is being transmitted by the follower 70 because the fixed follower is in a position in which it cannot accept forces. Subsequently when the fixed follower re-engages the part 46 completely, this follower will also transmit some of the force. Consequently during most of the motion in this direction the followers 70, 74 will transmit force.

Consider the situation which precedes the position shown in FIG. 5. When all three followers are fully engaged in part 46 of track 44, then, as previously described, followers 70, 74 will be transmitting force. Initially, the follower 70 reaches the junction of parts 46, 48 and while roller 84 crosses this junction it will not transmit force at all times. Accordingly when follower 84 can not transmit force then the force will be transmitted by the fixed follower 74.

Figure 7:
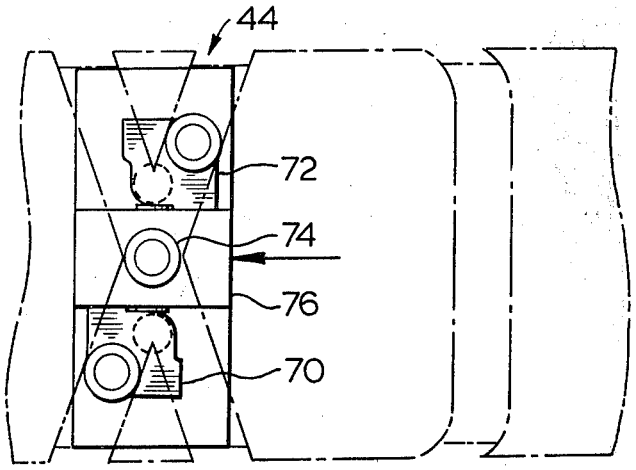

As the shaft 38 continues to rotate the follower 70 will reach the end of part 46 and move into engagement with part 52. Because this part deviates from the helix followed by part 46, the follower 70 will be moved about pivot pin 80 so that the fixed pin 74 will continue to take the load. As the rotation of shaft 38 continues a position will be reached such as that shown in FIG. 6 in which both of the pivotal followers are in intermediate positions with a central fixed follower taking all of the load. It will be evident that further rotation of shaft 38 will bring the leading follower 70 into engagement with part 46 of track 44 and that rotation about pivot pin 80 will be completed thereby bringing the surface 90 into engagement with face 102 of the block 76. Similarly, pivotal follower 72 will be rotated to bring one of the corresponding surfaces into engagement with face 102' on the other side of the block 76. Such a position is indicated in FIG. 7 and in this position, the follower 72 is now taking the load while the follower 70 is idling. Consequently, followers 72 and 74 combine to take the load while the block 76 is moving in the opposite direction to that discussed with reference to FIG. 5. This condition prevails until part 50 (FIG. 2) of track 44 is reached at which point the pivotal followers will be moved into a position similar to that shown in FIG. 6. Further rotation of shaft 38 will result in moving the followers into the FIG. 5 position and one cycle of reciprocation has then been completed.

The shapes of parts 50, 52 of the drive shaft 38 are less critical than in prior art structure. This is because the track needs only remain of constant width and be smooth where the parts 46, 48 meet parts 50, 52. Consequently a machine tool can be programmed to produce the the track 44 with a minimum of work by hand.

Although rollers are preferably used in the followers 70, 72 and 74, these parts could be replaced by hardened steel pins or the like where loading is not large. However in the exemplary use in association with a winch, the rollers would be used.

What I claim is:

1. A guide assembly for use with a winch and the like of the type having a drum, a drive to the drum, a drive chain adapted to drive a drive shaft coupled to the drive chain with the axis of the shaft parallel to that of the drum, the drive shaft being generally cylindrical and defining a track consisting of first and second helical parts disposed about the shaft in opposite directions and meeting one another at a plurality of junctions, and third and fourth parts defining respective end extremities of the track and linking the corresponding ends of said first and second parts, the guide assembly comprising: means to guide a rope; and a follower assembly, the rope guide means and the follower assembly being journalled about the drive shaft to permit rotation of the drive shaft in the follower assembly, the follower assembly including: a support block; a fixed follower mounted in the support block and adapted to engage in the track; and first and second pivotal followers turnably connected on the support block for movement about respective intersecting axes and adapted to engage in the track, the intersecting axes meeting at a first line drawn perpendicularly to a second line which on assembly is coincident with the axis of the drive shaft, the first line passing through the center of the fixed follower, each of the pivotal followers including a body member and means attached to the body member and engageable in the track, said means being offset from the corresponding one of said axes; and said body members and support block combining to limit turning of the pivotal followers between respective first positions in which these followers are positioned for engagement in said first part of the track, and respective second positions in which these followers are positioned for engagement in the second part of the track.

2. A spooling mechanism for use with a winch and the like of the type having a drum, a drive to the drum and a drive chain adapted to drive the spooling mechanism, the spooling mechanism comprising:

a drive shaft adapted to be coupled to the drive chain with the axis of the shaft parallel to that of the drum, the drive shaft being generally cylindrical and defining a track consisting of first and second helical parts disposed about the shaft in opposite directions and meeting one another at a plurality of junctions, and third and fourth parts defining respective end extremities of the track and linking the corresponding ends of said first and second parts;

a guide assembly including; means to guide a rope; and a follower assembly, the rope guide means and the follower assembly being journalled about the drive shaft to permit rotation of the drive shaft in the follower assembly, the follower assembly including: a support block; a fixed follower mounted in the support block and adapted to engage in the track; and first and second pivotal followers turnably connected on the support block for movement about respective intersecting axes and adapted to engage in the track, the intersecting axes meeting at a first line drawn perpendicularly to a second line which on assembly is coincident with the axis of the drive shaft, the first line passing through the centre of the fixed follower, each of the pivotal followers including a body member and means attached to the body member and engageable in the track, said means being offset from the corresponding one of said axes, and said body members and the support block combining to limit turning of the pivotal followers between respective first positions in which these followers are positioned for engagement in said first part of the track, and respective second positions in which these followers are positioned for engagement in the second part of the track.

3. A winch comprising:

a. a winch frame;

b. a drum rotatably coupled to the winch frame for rotation about a longitudinal axis of the drum;

c. a drive operably coupled to the drum to rotate the drum for winding rope on and off the drum;

d. a spooling mechanism for moving in a predetermined manner relative to the drum, the spooling mechanism comprising:

i. a drive shaft operably coupled to the drive with the axis of the shaft parallel to that of the drum, the drive shaft being generally cylindrical and defining a track consisting of first and second helical parts disposed about the shaft in opposite directions and meeting one another at a plurality of junctions, and third and fourth parts defining respective end extremities of the track and linking the corresponding ends of said first and second parts;

ii. a guide assembly including: means to guide a rope; and a follower assembly, the rope guide means and the follower assembly being journalled about the drive shaft to permit rotation of the drive shaft in the follower assembly, the follower assembly including: a support block; a fixed follower mounted in the support block and engaged in the track; and first and second pivotal followers turnably connected on the support block for movement about respective intersecting axes and engaged in the track, the intersecting axes meeting at a first line drawn perpendicularly to the axis of the drive shaft, the first line passing through the center of the fixed follower, each of the pivotal followers including a body member and means attached to the body member and engageable in the track, said means being offset from the corresponding one of said axes; and iii said body members and the support block combining to limit turning of the pivotal followers between respective first positions in which these followers are engaged in said first part of the track, and respective second positions in which these followers are engaged in the second part of the track.

* * * * *